US011415919B2

(12) United States Patent
Cohen et al.

(10) Patent No.: US 11,415,919 B2
(45) Date of Patent: Aug. 16, 2022

(54) PRINTING DEVICES

(71) Applicant: HEWLETT-PACKARD DEVELOPMENT COMPANY, L.P., Houston, TX (US)

(72) Inventors: Yaron Cohen, Nes Ziona (IL); Noam Zorero, Yavene (IL); Ofer Eluk, Nes Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 659 days.

(21) Appl. No.: 15/471,605

(22) Filed: Mar. 28, 2017

(65) Prior Publication Data

US 2018/0284676 A1 Oct. 4, 2018

(51) Int. Cl.
*G03G 15/00* (2006.01)

(52) U.S. Cl.
CPC ..... *G03G 15/5062* (2013.01); *G03G 15/652* (2013.01)

(58) Field of Classification Search
CPC .. G03G 15/5062; G03G 15/00; G03G 15/652; G03G 21/00; G03G 21/14
USPC ..... 399/384
See application file for complete search history.

(56) References Cited

U.S. PATENT DOCUMENTS 6,203,131 B1 3/2001 Wiklof
6,823,786 B1 11/2004 Shmaiser et al.
7,552,995 B2 * 6/2009 Nakazawa ..... B41J 3/60 347/19
7,856,927 B2 12/2010 Peleg et al.
8,427,705 B2 4/2013 Young et al.
2003/0165349 A1 9/2003 Nakazawa
2004/0057070 A1 * 3/2004 Hanazato ..... B41J 11/46 358/1.14
2009/0148181 A1 * 6/2009 Niihara ..... G03G 15/6591 399/126
2010/0209160 A1 * 8/2010 Mizes ..... B41J 3/543 399/384
2010/0294154 A1 * 11/2010 Rapkin ..... G03G 15/5062 101/486
2010/0329765 A1 12/2010 Ruhm et al.
2013/0233191 A1 * 9/2013 Mo ..... B41J 3/54 101/490

(Continued)

FOREIGN PATENT DOCUMENTS

EP 0239845 A1 * 3/1987 ..... G03G 15/00
EP 1708043 10/2006

OTHER PUBLICATIONS

Brandenburg, et al.; "Multi-motor Electronic Line Shafts for Rotary Offset Printing Pressesa Revolution in Printing Machine Techniques"; http://ieeexplore.ieee.org/document/743580/; 1998.

*Primary Examiner* — Nguyen Q. Ha
(74) *Attorney, Agent, or Firm* — Fabian VanCott

(57) ABSTRACT

A printing device may include a first print engine to print a first image in a first area of a web substrate and leave blank a second area of the web substrate, a second print engine in series with the first print engine to print a second image on the second area of the web substrate in simplex. The printing device may also include an optical sensor to identify a number of alignment indicators on the web substrate, and a controller to engage the second print engine with the web substrate based on the identification of the alignment indicators by the optical sensor.

20 Claims, 8 Drawing Sheets

(56) References Cited

U.S. PATENT DOCUMENTS

| | | | | |
|---|---|---|---|---|
| 2015/0070452 | A1* | 3/2015 | Motoyanagi | B41J 3/60<br>347/102 |
| 2015/0077468 | A1* | 3/2015 | Suzuki | B41J 2/17523<br>347/37 |
| 2015/0239230 | A1* | 8/2015 | Vermeulen | B41F 19/02<br>101/27 |

* cited by examiner

PRINTING DEVICES

BACKGROUND

Web presses may be used in large-scale printing operations. A web press device may utilize a continuous roll or web of printable substrate made of, for example, paper, may be continuously fed through a print engine in the web press. As the substrate is fed through the print engine, a number of colorants may be applied to the substrate by the print engine to form desired text and/or images on the substrate. The use of a web of substrate may enable the web press to feed the substrate through the print engine without having to individually feed separate sheets of paper. This saves time in printing and simplifies substrate loading procedures. After an image has been printed on the substrate, the printed portion of the substrate may be cut according to desired dimensions.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
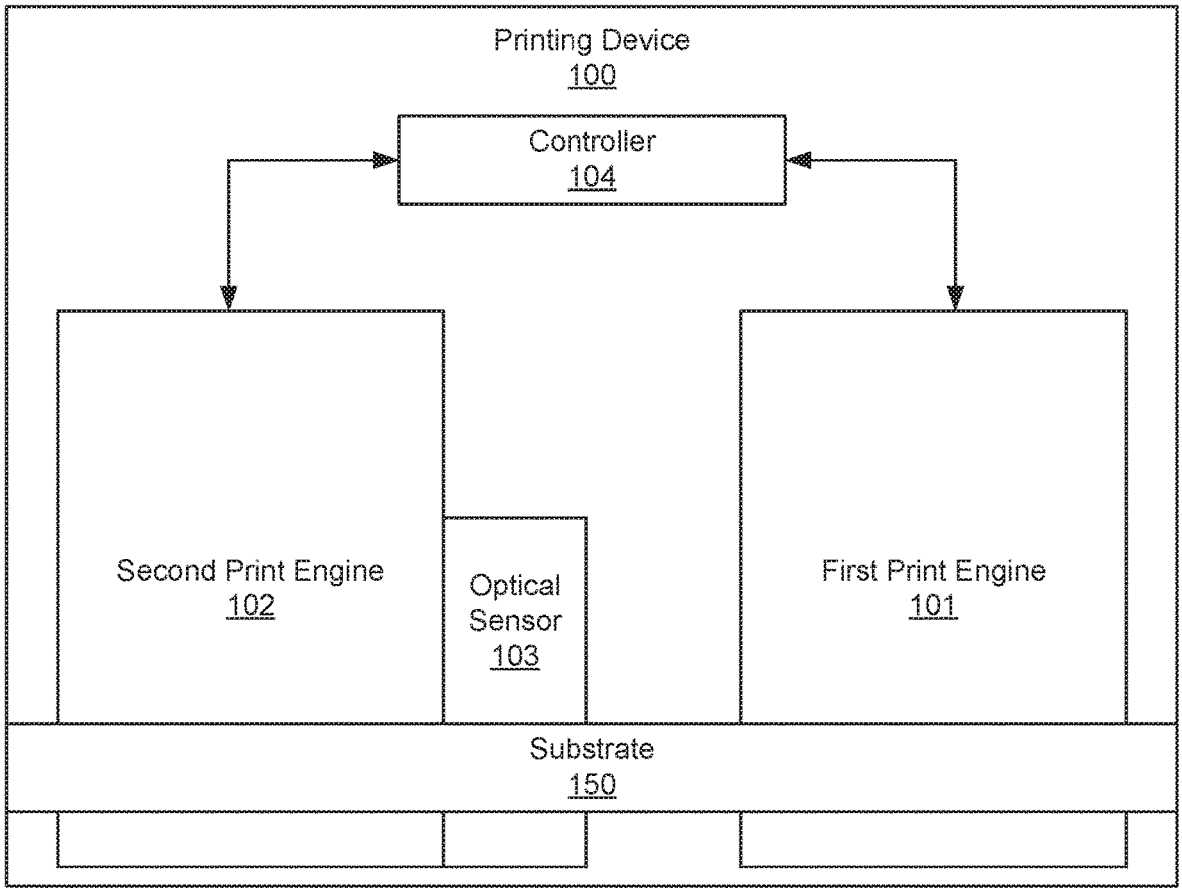
FIG. 1 is a block diagram of a printing device, according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In some cases, web presses may include two or more printing engines operating in tandem to achieve increased productivity. For example, dual web presses may combine two print engines such that the two print engines both print on the substrate. However, these devices are synchronized between the print engines as the substrate advances in order to simultaneously print the correct images on the substrate while maintaining a specified document print order and alignment between images printed on the substrate. Accordingly, a great deal of development effort has been made to achieve this level of hardware and software synchronization between the print engines.

In printing systems where a plurality of print engines may operate in tandem to print on a common web substrate, the web substrate is synchronously fed through the print engines due to the continuous nature of the web substrate and the placement of printed text and/or images on the web substrate. Forcing separate print engines to advance a substrate synchronously may reduce efficiency due to the hardware and software processes taken to adequately synchronize print operations between the plurality of print engines.

Examples described herein provide a printing device including a first print engine to print a first image in a first area of a web substrate and leave blank a second area of the web substrate, a second print engine in series with the first print engine to print a second image on the second area of the web substrate in simplex. The printing device may also include an optical sensor to identify a number of alignment indicators on the web substrate, and a controller to engage the second print engine with the web substrate based on the identification of the alignment indicators by the optical sensor.

In one example, the first print engine and the second print engine both print at least four colors and white to the web substrate. The printing device may further include a buffer disposed between the first and second print engines. The buffer stores a variable amount of web substrate received from the first print engine and feed the web substrate to the second print engine. Further, the buffer maintains the variable amount of web substrate at a substantially constant tension. Each of the first and second print engines prints to the web substrate independent of a speed or print phase of the other of the first and second print engines.

The printing device may further include a web guide disposed between the buffer and the second print engine to position the web substrate at an input of the second print engine. The controller engages the second print engine with the web substrate based on the identification of the alignment indicators by the optical sensor. The printing device includes circuitry in the first print engine to receive data from the linear encoder and stall print operations in the first print engine if the data indicates that the buffer is full, and circuitry in the second print engine to receive the data and stall print operations in the second print engine if the data indicates that the buffer comprises less substrate than an amount for continued print operations. The data corresponds to an amount of web substrate stored in the buffer. Each of the print engines selectively performs a null printing cycle, a stalled printing cycle, or combinations thereof, to synchronize print operations between the first and second print engines.

Examples described herein also provide a system for printing to a substrate. The system may include a first print engine to print a first image in a first area of the substrate and leave blank a second area of the first side of the substrate, a second print engine in series with the first print engine to print a second image on the second area of the first side in simplex, an optical sensor to identify a number of alignment indicators, a controller to engage the second print engine with the substrate based on the identification of the alignment indicators by the optical sensor. The controller includes circuitry in the first print engine to receive data from the linear encoder and stall print operations in the first print engine if the data indicates that a buffer is full, and circuitry in the second print engine to receive the data and stall print operations in the second print engine if the data indicates that the buffer comprises less substrate than an amount for continued print operations. The data corresponds to an amount of substrate stored in the buffer.

The first print engine and the second print engine both print white to the substrate. Further, the first print engine and the second print engine both print at any number of colors in addition to the white. The system may further include control circuitry coupled to the buffer to activate an actuator to maintain the constant tension on the substrate based on data from a tension sensor within the buffer. Each of the print engines selectively performs a null printing cycle, a stalled printing cycle, or combinations thereof, to synchronize print operations between the print engines.

Examples described herein also provide a system including a first print engine to print a first image in a first area of the print substrate and leave blank a second area of the print substrate, a second print engine in series with the first print engine to print a second image on the second area of the print substrate in simplex, and a controller. The controller receives data from a linear encoder defining an amount of print substrate stored in a buffer, and stall print operations in the first print engine if the data indicates that the buffer is full, and stall print operations in the second print engine if the data indicates that the buffer comprises less print substrate than an amount for continued print operations. In one example, the optical sensor may be positioned in the second print engine, and identifies a number of alignment indicators printed by the first print engine.

As used in the present specification and in the appended claims, the term "image" when used in connection with the printing of an image onto a print medium is meant to be understood broadly as any text, picture, symbol, shape, color, other marks, or combinations thereof.

Additionally, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Turning now to the figures, FIG. 1 is a block diagram of a printing device, according to an example of the principles described herein. The printing device (100) may be any device used to print images and/or text on a continuous web substrate (150). As used in the present specification and in the appended claims, the term "web substrate" refers to a continuous sheet of a substrate, such as paper, that is stored on a reel and provided to the printing device (100) by unrolling the reel.

The printing device (100) and other printing systems and devices described herein may include a first print engine (101) to print a first image in a first area of the web substrate (150) and leaves blank a second area of the first side of the web substrate (150). The printing device (100) may further include a second print engine (102) in series with the first print engine (101). The second print engine (102) prints a second image on the second area of the first side of the web substrate (102). The process of the first print engine (101) printing on a first area of the web substrate (150), leaving a second area of the web substrate (150), blank, and having the second print engine (102) print to the blank second area of the web substrate (150) may be referred to herein as a "stamp and blank" printing process. The first (101) and second (102) print engines may be print engines used within large-scale digital printing press systems, such as, for example, those used in the INDIGO® printing presses and devices manufactured and distributed Hewlett Packard, Inc.

In the examples described herein, the first print engine (101) and the second print engine (102) print on the web substrate (100) in simplex, or on one side of the web substrate (150) as opposed to duplex printing where printing of text and/or images occurs on both sides of the web substrate. However, in one example, the simplex, stamp and blank process described herein may be used to print on both sides of the web substrate (150). In this example, the two print engines (101, 102) may print in simplex using the stamp and blank process described herein, and the web substrate (150) may be either reintroduced into the two print engines (101, 102) or into another set of tandem print engines in an inverted orientation so that a second simplex, stamp and blank process may be performed on the opposite side of the web substrate (150). In this manner, the web substrate (150) may be printed on both sides while benefitting from the speed in printing provided by the stamp and blank process described herein.

The printing device (100) may also include an optical sensor (103) to identify a number of alignment indicators located on the web substrate (150). The alignment indicators may be used to identify the border between a printed area and a blank area, or between areas of the web substrate (150) on which the first print engine (101) prints and areas of the web substrate (150) on which the second print engine (102) prints. The optical sensor (103) may be any optical device capable of imaging the web substrate (150) and returning data to a controller based on the imaged alignment indicators to allow the controller to control alignment of the web substrate (150) within the first print engine (101) and the second print engine (102). The controller ensures that the web substrate (150) is aligned with the printing mechanisms of the second print engine (102) after printing on the web substrate (150) by the first print engine (101) to allow the second print engine (102) to print on the blank area of the web substrate (150) left blank by the first print engine (101).

A controller (104) may also be included within the printing device (100). The controller (104) causes the second print engine (102) to engage with the web substrate (150) based on the identification of the alignment indicators by the optical sensor (103). The controller (104) may provide the first (101) and second (102) print engines with data corresponding to a number of images to be printed on the web substrate (150) in a format readable by the print engines (101, 102). The data provided by the controller (104) may include print operations data, feed data, and any other data used by the print engines (101, 102) to print the images. Further, the controller (104) may translate data corresponding to a document to be printed, to machine-level data for each of the print engines (101, 102) to interpret. The controller (104) may coordinate the operations of the first (101) and second (102) print engines to align print operations in the print engines (101, 102) that correspond to each other with a desired portion of web substrate (150) based on the stamp and blank printing process between the first print engine (101) and second print engine (102) described herein.

As described herein, the controller (104) causes the second print engine (102) to engage with the web substrate (150) based on data from a linear encoder within a web substrate buffer, based on identification of the alignment indicators by the optical sensor (103), or combinations thereof. The controller (104), the first print engine (101), or a combination thereof may include circuitry to receive data from linear encoder, and stall print operations in the first print engine (101) if the data indicates that a web substrate buffer interposed between the first (101) and second (102) print engines is full of its capacity of web substrate (150). The linear encoder may send data about the web substrate buffer position, and an amount of web substrate (150) to the controller (104) so the controller (140) may determine if printing may continue or of printing should be stalled. Further, the controller (104), the second print engine (102), or a combination thereof may include circuitry to receive the data from the linear encoder and stall print operations in the second print engine (102) if the data indicates that the web substrate buffer includes less substrate than an amount for continued print operations. The data provided to the first (101) and second (102) print engines from the linear encoder corresponds to an amount of web substrate (150) stored in the buffer. More regarding the buffer is described herein.

Further, the controller (104) may receive data from the linear encoder where the data defines an amount of web substrate (150) stored in a web substrate buffer. The controller (104) instructs the first print engine (101) to stall print operations in the first print engine (101) if the data from the linear encoder indicates that the buffer is full. Further, the controller (104) instructs the second print engine (102) to stall print operations in the second print engine (102) if the data from the linear encoder indicates that the buffer includes less web substrate (1500 than an amount for continued print operations. More regarding the linear encoder is described herein.

Each of the print engines (101, 102) selectively performs a null printing cycle, a stalled printing cycle, or combinations thereof, to synchronize print operations between the first (101) and second (102) print engines. In a null cycle, the web substrate (150) may be advanced through at least one of the print engines (101, 102) without any print operations being performed on the web substrate (150) by at least one of the print engines (101, 102). In a stall cycle, a printing engine (101, 102) may pause operations for a specified amount of time without losing its position on the web substrate (150). Moreover, after running a stall cycle, a printing engine (101, 102) may compensate for deceleration and acceleration in printing operations without wasting web substrate (150). Null and stall cycles may be used by the print engines (101, 102) to coordinate print operations by each of the print engines (101, 102) in corresponding portions of the web substrate (150). Additionally, stall cycles may be used to delay print operations while the print engines (101, 102) are reconfigured.

These null and stall cycles may be injected into the printer operation queues of the print engines (101, 103) by the controller (104). The controller (104) correlates operations of the two print engines (101, 102). In one example, the operations of the controller (104) and/or the print engines (101, 102) may be configured, altered, and/or canceled on the fly by a user at a workstation.

In one example, each of the first (101) and second (102) print engines may print at least four colors of printable fluid plus a white printable fluid. In this manner, both print engines (101, 102) are able to print an entire image on their respective areas of the web substrate (150) independent of the other print engine (101, 102). In one example, the first print engine (101) may print a different image on the first print engine's (101) respective areas of the web substrate (150) relative to an image printed by the second print engine (102) on the second print engine's (102) respective areas of the web substrate (150).

In another example, the first print engine (101) may print the same image on the first print engine's (101) respective areas of the web substrate (150) as the image printed by the second print engine (102) on the second print engine's (102) respective areas of the web substrate (150). In any of these examples, the printing device (100) is able to print at least double the rate as is possible with a printing system or device with a single print engine. In one example, the present printing systems are able to print on the web substrate (150) at least approximately 33 meters of web substrate (150) per minute (m/min). In another example, the present printing systems are able to print on the web substrate (150) at least approximately 80 m/min.

Further, in one example, the color printing configurations for the two print engines (101, 102) may be the same such that the two print engines (101, 102) print the same colors. In this example, each print engine (101, 102) may print, for example, cyan (C), magenta (M), yellow (Y), black (K), and white ON) (CMYK+W). However, the two print engines (101, 102) may print a different color pallet than this example, but print the same color set. Still further, each of the first (101) and second (102) print engines prints to the web substrate (150) independent of a speed or print phase of the other of the first (101) and second (102) print engines. This allows for data sent to each of the print engines (101, 102) to be processed and utilized by the print engines (101, 102), increasing the speed at which the printing device (100) can print the images to the web substrate (150).

Figure 2A:
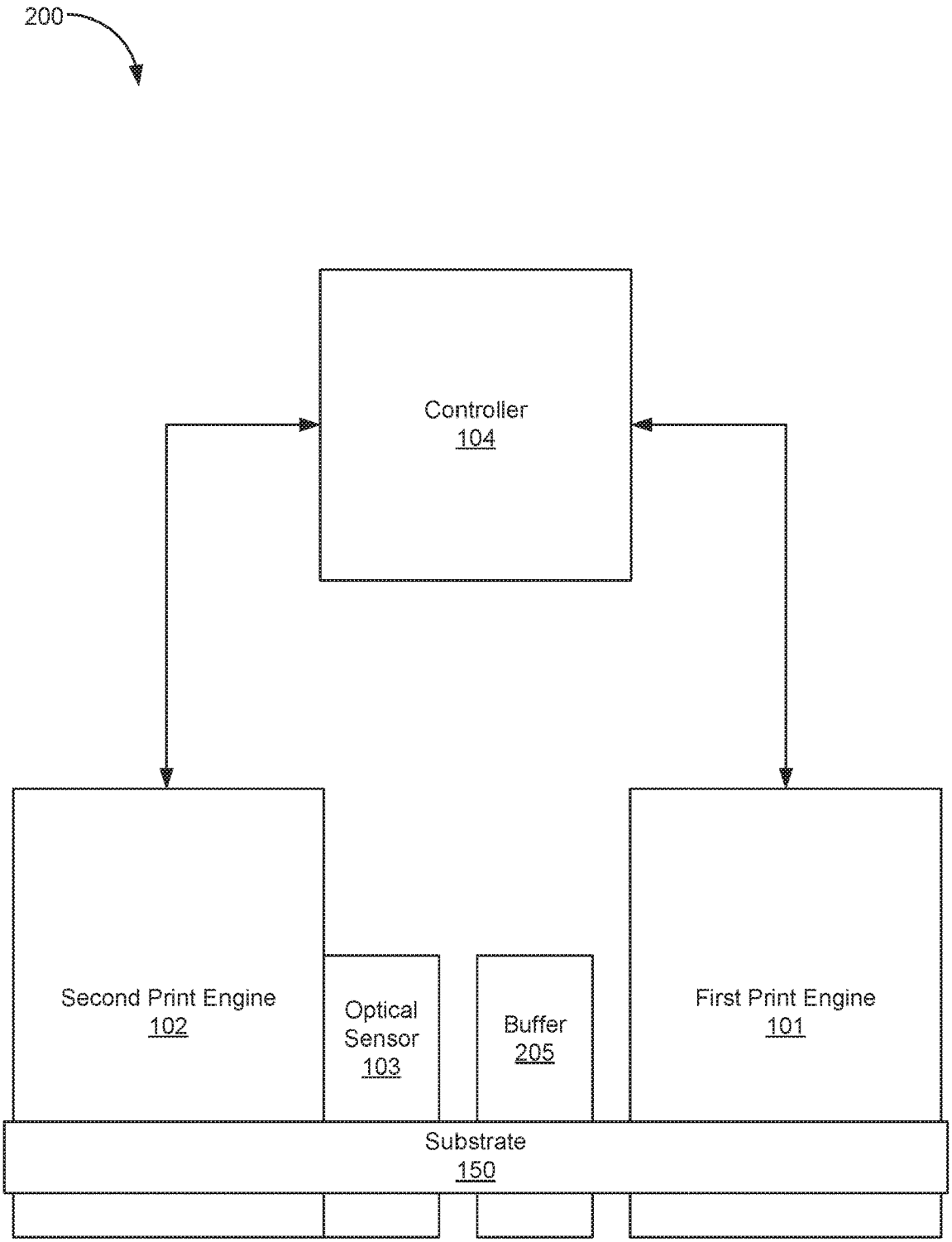
FIG. 2A is a block diagram of a system for printing to a substrate, according to an example of the principles described herein.

FIG. 2A is a block diagram of a system (200) for printing to a web substrate (150), according to an example of the principles described herein. Those elements similarly numbered in FIG. 2 relative to FIG. 1 are described above in connection with FIG. 1 and other portions herein. The system (200) of FIG. 2 may further include a web substrate buffer (205) disposed between the first (101) and second (102) print engines. The buffer (205) may store a variable amount of web substrate (150) received from the first print engine (101) and feed the web substrate (150) to the second print engine (102) at a consumable rate of the second print engine (102), and may allow each print engine (101, 102) to perform print operations to the web substrate (150) irrespective of a speed or print phase of the other print engine (101, 102). The buffer (150) may include a plurality of rollers to house and transport the web substrate (150). The web substrate (150) may wrap around portions of the outer circumferential surfaces of the rollers such that the rollers rotate as the web substrate (150) is fed through the buffer (205). Further, the buffer (150) maintains the variable amount of web substrate (150) at a substantially constant tension so that the second printing device (102) may receive the web substrate (150) at an operating level of tension.

Due to the first (101) and second (102) print engines being able to perform print operations substantially independent of each other, the first print engine (101) may output the web substrate (150) to the buffer (205) at different rates and times than those at which the second print engine (102) is able to receive the web substrate (150). Thus, the amount of web substrate (150) housed in the buffer (205) may change dynamically during printing operations.

The rollers within the buffer (205) may maintain the dynamic amounts of the web substrate (150) at a substantially constant tension. Under this tension, friction between the outer circumferential surfaces of the rollers may help to enable smooth feeding of the web substrate (150) from the first print engine (101) through the buffer (205) and into the second print engine (102), avoiding jamming of the web substrate (150) within the system (200). At least one of the rollers may selectively move along a number of axes to accommodate for more or less of the substrate (150) to be stored in the buffer (150). Thus, when the average distance between adjacent rollers within the buffer (205) is at a maximum, the buffer (205) may be operating at full capacity and not able to store any more of the web substrate (150) at the desired tension. Similarly, when the average distance between the rollers is at a minimum, the buffer (205) may be operating at a minimum capacity, and unable to provide more of the web substrate (150) to the second print engine (102) without damaging the web substrate (150) or causing print jams or other complications within the print engines (101, 102) or the buffer (205).

Further, the buffer (205) may include the rollers positioned in intermediate states, according to the dynamic storage of the buffer (205), and may be adjusted on the fly during a printing process to allow for the first (101) and second (102) print engines to operate independent of one another as they print using the stamp and blank process described herein. For example, the first print engine (101) prints a first image in a first area of the web substrate (150), and leaves blank a second area of the first side of the web substrate (150). This stamped and blanked printed web substrate (150) is collected by the buffer (205). The controller (104) causes the second print engine (102) to engage with the web substrate (150) based on data received from the optical sensor (103. Further, once the second print engine (102) engages with the web substrate (150), the buffer (205) provides the web substrate (150) to the second print engine (102). The buffer (205) reacts to the positions of the print engines (101, 102), and, in instances where there is a speed difference between the first print engine (101) and the second print engine (102), the buffer (205) fills or empties based on the actions performed at the print engines (101, 102). For example, in instances where the second print engine (102) were to stop printing to, for example, synchronize the web substrate (150) with the printing processes of the second print engine (102) and the images printed on the web substrate (150) by the first print engine (101), the first print engine (101) may continue to print until the buffer (205) fills to capacity. The linear encoder (215) will send a signal to the first print engine (101) to stop printing until the second print engine (102) engages with the web substrate (150), and begins to draw the web substrate (150) from the buffer (205) and the linear encoder (215) indicates that the buffer (205) can contain more web substrate (250).

The controller (104) instructs the buffer (205) to decelerate and accelerate the feeding of the web substrate (150) into the second print engine (102) based on the second print engine's (102) ability to begin printing, ramp up its speed of printing, and stop printing. Further, the controller (104) instructs the buffer (205) to decelerate and accelerate the collection of the web substrate (150) into the buffer (205) based on the first print engine's (101) ability to begin printing, ramp up its speed of printing, and stop printing. In this manner, the first (101) and second (102) print engines may operate independent of one another in as much as the buffer (205) is able to collect, store, and distribute the web substrate (150).

Figure 2B:
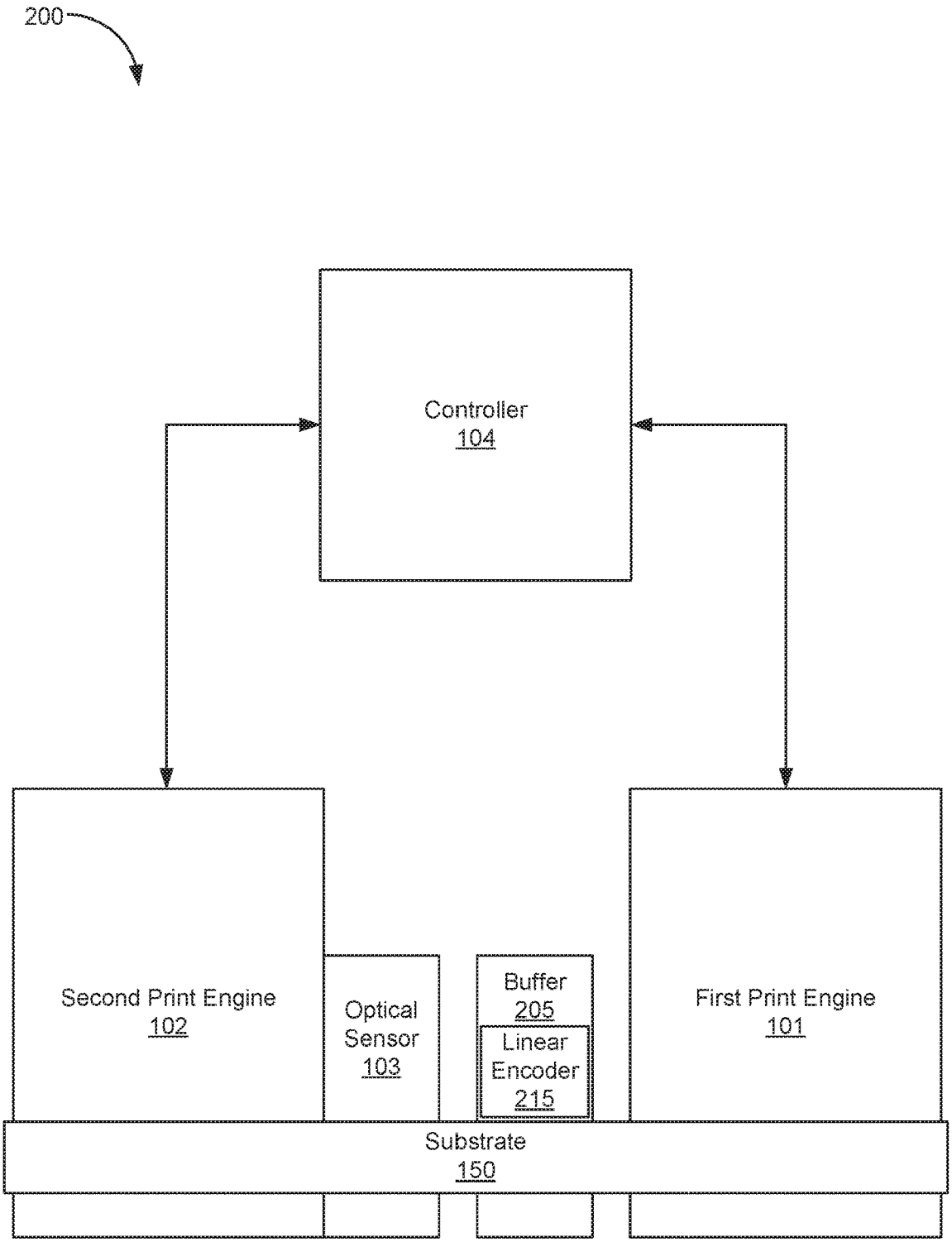
FIG. 2B is a block diagram of a system for printing to a substrate, according to another example of the principles described herein.

FIG. 2B is a block diagram of a system (200) for printing to a web substrate (150), according to another example of the principles described herein. Those elements similarly numbered in FIG. 2B relative to FIGS. 1 and 2A are described above in connection with FIGS. 1 and 2A and other portions herein. The system (200) may further include a linear encoder (215). The linear encoder (215) may be any device that determines the distance between a number of rollers within the buffer (205). In one example, the information provided by the linear encoder (215) may be provided to the controller (104), the control circuitry of the first print engine (101), the control circuitry of the second print engine (102), or combinations thereof. In another example, the information provided by the linear encoder (215) may be provided to a processor of a printing device (100) into which the web substrate buffer (205) is included. Using this information, the amount of web substrate (150) may be increased or decreased based on the web substrate collection within the buffer (205).

Figure 3:
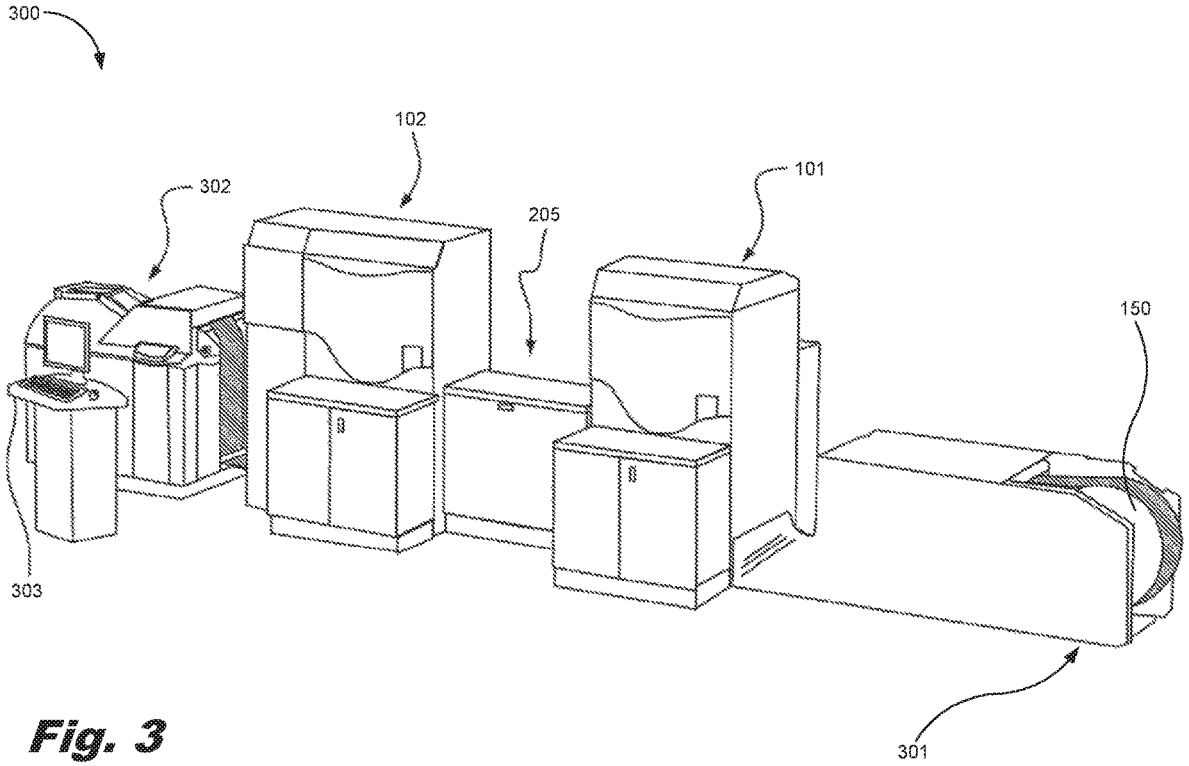
FIG. 3 is a perspective view of a system for printing to a substrate, according to an example of the principles described herein.
Figure 4:
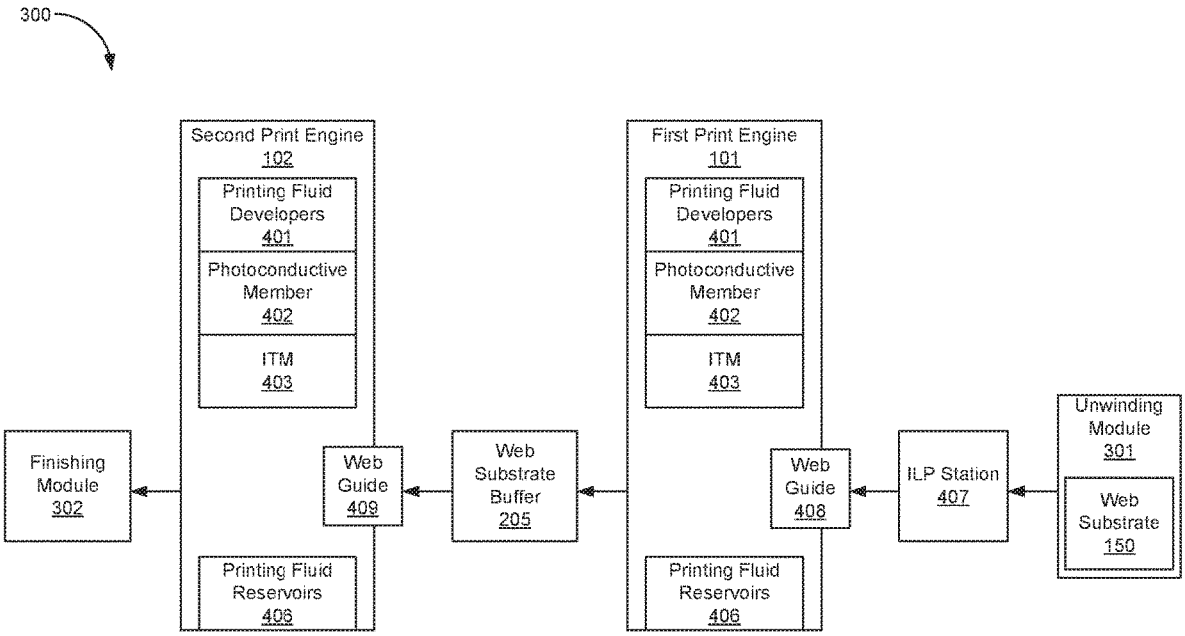
FIG. 4 is a perspective view of the system of FIG. 3 depicting some internal elements of the components of the system, according to an example of the principles described herein.

FIG. 3 is a perspective view of a system (300) for printing to a substrate (150), according to an example of the principles described herein. Further, FIG. 4 is a perspective view of the system (300) of FIG. 3 depicting some internal elements of the components of the system (300), according to an example of the principles described herein. Those elements similarly numbered in FIGS. 3 and 4 relative to FIGS. 1 through 2B are described above in connection with FIGS. 1 through 2B and other portions herein. The system (300) may include an unwinding module (301) may house a roll of web substrate (150) and feed the web substrate (150) to the first print engine (101). The unwinding module (301) may include a roll lift to lift the roll of web substrate (150) as the web substrate (150) is consumed, thus maintaining a desired alignment with transport components within the unwinding module (301) throughout print operations. The unwinding module (301) may also include a device to unwind the roll of web substrate (150) as the web substrate (150) is consumed.

The first print engine (101) may receive the substrate (150) as needed from the unwinding module (301) and print on a first side of the substrate (150). The buffer (205), as described herein, may store a variable amount of web substrate (150) received from the first print engine (101) and feed the substrate (150) to the second print engine (102) as needed. As described herein, each of the print engines (101, 102) may print to the web substrate (150) independent of the rate at which the substrate (150) is being consumed by the other of the print engine (101, 102). However, each of the print engines (101, 102) may be communicatively coupled to the buffer (205), and the buffer (205) may increase, stall, or slow print operations if the buffer (205) is either too full or too empty to allow print operations to continue. A finishing module (302) may receive the printed substrate (150) from the second print engine (102). The finishing module (302) performs operations such as cutting the substrate (150) into individual sheets, stacking the sheets, and outputting the sheets to a user.

As depicted in FIG. 4, each of the print engines (101, 102) may include a number of printing fluid developers (401) oriented around a photoconductive member (402) such as a photoimaging plate (PIP), photoelectric drum, or another photoelectric member. The printing fluid developers (401) may be binary printing fluid developers (BPFDs) in one example. As described herein, each of the printing fluid developers (401) may be oriented differently around to the photoconductive member (402) such that the orientation of each of the printing fluid developers (401) may vary from vertical to horizontal.

Along with the other elements described in connection with the printing fluid developers (401) described herein, the system (300) may further include the photoconductive member (402), a charging device, a photo imaging device, an intermediate transfer member (ITM) (403), an impression cylinder, a discharging device, a cleaning station and other elements used to transfer images to the web substrate (150). The printing fluid developers (401) are disposed adjacent to the photoconductive member (402) and may correspond to various colors such as cyan, magenta, yellow, black, and other colors. The charging device applies an electrostatic charge to a photoconductive surface such as the outer surface of the photoconductive member (402). A photo imaging device such as a laser exposes selected areas on the photoconductive member (402) to light in a pattern of the desired printed image to dissipate the charge on the selected areas of photoconductive member (402) exposed to the light.

For example, the discharged areas on photoconductive member (402) form an electrostatic image which corresponds to the image to be printed. A thin layer of printing fluid is applied to the patterned photoconductive member (402) using the various printing fluid developers (401) to form the latent image thereon. The printing fluid adheres to the discharged areas of photoconductive member (402) in a layer of printing fluid on the photoconductive member (402) and develops the latent electrostatic image into a toner image, the toner image is transferred from the photoconductive member (402) to the ITM (403). Subsequently, the toner image is transferred from the ITM (402) to the web substrate (150) as the web substrate (150) passes through an impression nip formed between the ITM (403) and the impression cylinder. The discharging device may remove residual charge from the photoconductive member (402). The cleaning station removes toner residue in preparation of developing the new image or applying the next toner color plane. Each of the print engines (101, 102) may also include a number of printing fluid reservoirs (406). The printing fluid reservoirs (406) provide the printing fluid developers (401) of the print engines (101, 102) with a source of printing fluid for printing.

The system (300) may further include an in-line priming (ILP) station (407) for preparing the web substrate (150) for printing. The ILP station (407) may apply a number of surface treatments to the web substrate (150) that alters the surface tension of the web substrate (150), increases the ability of printing fluids to adhere to the web substrate (150), and otherwise prepare the web substrate (150) for printing. The system (300) may further include a number of web guides (408, 409) included before each of the print engines (101, 102). The web guides (408, 409) may guide the web substrate (150) from an output of the ILP station (407) and the buffer (205) to an input of the first (101) and second (102) print engines, respectively. The web guides (408, 409) position the web substrate (150) such that the print engines (101, 102) receive the web substrate (150) in an orientation and position appropriate for printing. In one example, the web guides (408, 409) may include a number of powered rollers.

The system (300) may further include a workstation (303). The workstation (303) may include any number of user interfaces through which a user may control the operation of the system (300). For example, the workstation (303) may include a display device, a keyboard, a mouse, or other user input and output devices. In one example, the workstation (303) may be used to instruct the system (300) to execute a number of print jobs.

Figure 5:
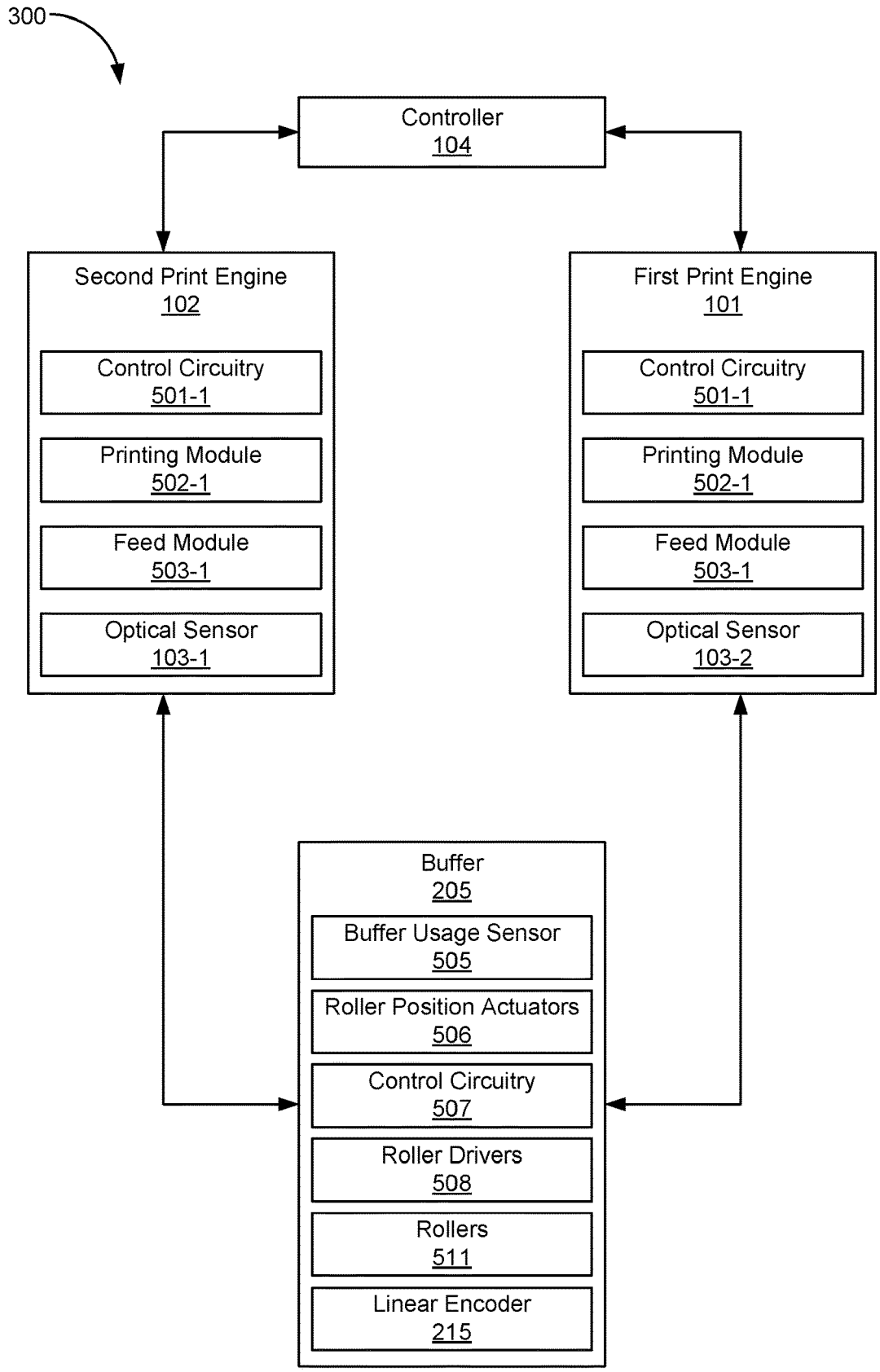
FIG. 5 is a block diagram of electronic modules within a system for printing to a substrate, according to an example of the principals described herein.

FIG. 5 is a block diagram of electronic modules within a system (300) for printing to a substrate (150), according to an example of the principals described herein. Those elements similarly numbered in FIG. 5 relative to FIGS. 1 through 4 are described above in connection with FIGS. 1 through 4 and other portions herein. The buffer (205) disposed intermediate the first (101) and second (102) print engines may store a variable amount of web substrate received from the first print engine (101) and feed the substrate to the second print engine (102).

The controller (104), each of the print engines (101, 102), or combinations thereof may include control circuitry (501-1, 501-2) to control operations of a printing module (502-1, 502-2) and a feed module (503-1, 503-2). The printing modules (502-1, 502-2) may perform the actual print operations on the web substrate (150), while the feed modules (503-1, 503-2) may transport the substrate through the print engines (101, 102). The control circuitry (501-1, 501-2) in at least one of the print engines (101, 102) may receive data from the optical sensor (103) that detects the presence of alignment indicators on the web substrate (150). By tracking the alignment indicators on the web substrate (150), corresponding print operations may be coordinated between the print engines (101, 102) consistent with principles described herein.

Additionally, the control circuitry (501-1, 501-2) in each of the print engines (101, 102) may receive information from the buffer (205). In on example, a buffer usage sensor (505) included in the buffer (205) may be a position sensor that detects the position of dynamically translatable rollers (511) in the buffer (205). The buffer usage sensor (505) of the buffer (205) may provide buffer data to the control circuitry (501-1, 501-2) corresponding to the amount of substrate being stored in the buffer (205) in the context of the capacity of the buffer (205). This buffer data may be used by the first print engine (101) to stall print operations if the buffer (205) does not have the capacity to receive additional substrate from the first print engine (101). Additionally, the buffer data may be used by the second print engine (102) to stall print operations if the buffer (205) does not have a sufficient amount of substrate stored to provide to the second print engine (102) for its print operations.

The buffer (205) may also include a roller position actuator (506), such as a hydraulic actuator and/or an electric motor. This actuator (506) dynamically translates a number of rollers (511) in the buffer (205) as the amount of web substrate (150) stored in the buffer (205) varies in order to maintain the substrate at a constant desired tension.

At least one of the roller drivers (508) in the buffer (205), such as electric motors, may rotate at least one of a plurality of rollers (511) in the buffer (205) to feed the web substrate (150) through the buffer (205). Control circuitry (507) within the buffer (205) may control operations of the buffer (205), such as by selectively activating the roller position actuator(s) (506) and the roller drive(s) (508). Additionally, the control circuitry (507) of the buffer (205) may communicate with the control circuitry (501-1, 501-2) of the print engines (101, 102) to provide buffer usage data extrapolated from the buffer usage sensor (505) to the print engines (101, 102).

The buffer (205) may further include a linear encoder (215). The linear encoder (215) may be any device that can determine the distance between a first set of rollers (511) within the buffer (205) and a second set of rollers (511) within the buffer (205). In one example, the information provided by the linear encoder (215) may be provided to the controller (104), the first print engine (101), the second print engine (102), or combinations thereof. In another example, the information provided by the linear encoder (215) may be provided to a processor of a printing device (100) in which the web substrate buffer (205) is included. Using this information, the amount of web substrate (150) may be increased or decreased based on the web substrate usage of the first and second moveable carriages (120, 125).

Further, the system (300) may utilize the controller (104) to control the first print engine (101) and second print engine (102) to perform the stamp and blank printing process described herein by instructing the first print engine (101) to print a first image in a first area of the web substrate (150) and leave blank a second area of the first side of the web substrate (150). In one example where alignment indicators are pre-printed on the web substrate (150), an optical sensor (103-1) associated with the first print engine (101) may be used to identify a number of the alignment indicators located on the web substrate (150), and print on every other area of the web substrate (150) delineated by the alignment indicators.

In one example where the alignment indicators are not pre-printed on the web substrate (150), the controller (104) may instruct the first print engine (101) to print on a first length of the web substrate (150) and leave an amount of the web substrate (150) blank for printing on by the second print engine (102). In this example, the alignment indicators used by the second print engine (102) to align the web substrate (150) in order to print to the blank portions of the web substrate (150) may be printed by the first print engine (101). In this example, the controller (104), the first print engine (101), another processing device, or a combination thereof may add the to-be-printed alignment indicators to the digital image provided to the first print engine (101) for printing to the web substrate (150). Further, in one example, the size, including length and width of the area the first print engine (101) prints on the web substrate (150) may be larger, equal to, or smaller than the size, including length and width of the area the second print engine (102) prints on the web substrate (150).

The controller (104) may instruct the buffer (205) to buffer the web substrate (150) and feed the second print engine (102) the web substrate (150). The controller (104) may also instruct the optical sensor (103-2) associated with the second print engine (102) to identify a number of the alignment indicators located on the web substrate (150), and instruct the second print engine (102) to engage the web substrate (150) in a timely manner based on the data obtained from the optical sensor (103-2) and such that a blank portion of the web substrate (150) left blank by the first print engine (101) may be presented to the printing elements of the second print engine (102) for printing without overlapping the portions of the web substrate (150) printed on by the first print engine (101). More regarding the stamp and blank process performed by the system (300) will now be described in connection with FIG. 6.

Figure 6:
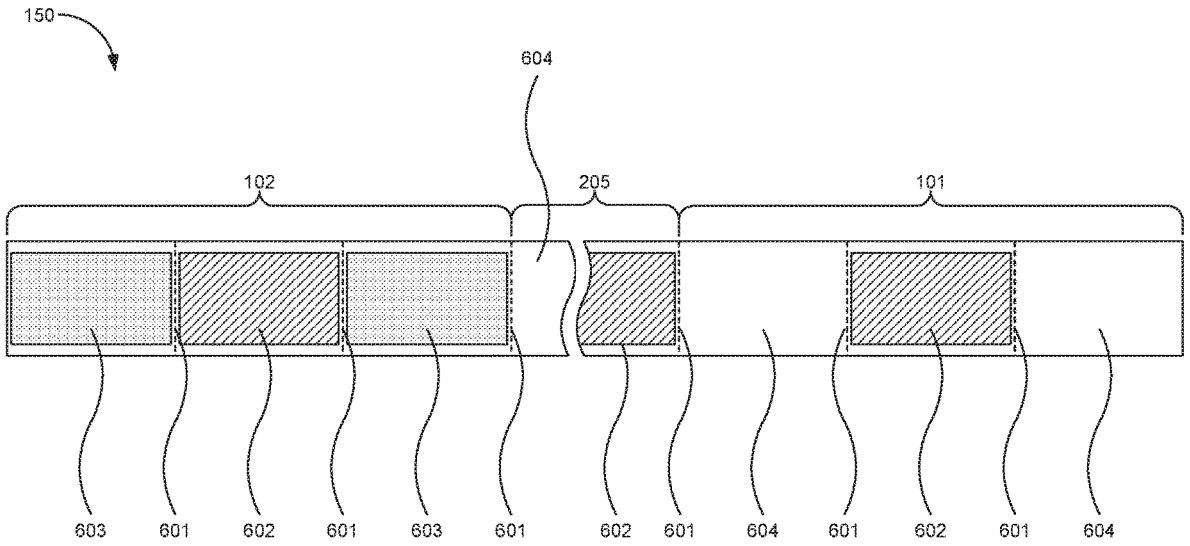
FIG. 6 is a block diagram of a substrate printed on by the systems described herein, according to an example of the principles described herein.

FIG. 6 is a block diagram of a web substrate (150) printed on by the systems (100, 200, 300) described herein, according to an example of the principles described herein. The web substrate (150) may include a number of alignment indicators (601) either pre-printed on the web substrate (150), or printed by the first print engine (101) as described herein. Again, the spacing between the alignment indicators (601) may be larger, equal to, or smaller, along the web or across the web than an adjacent set of alignment indicators (601) to allow for the first (101) and second (102) print engines to print to equal or unequal sizes of area of the web substrate (150). The use of the optical sensors (103-1, 103-2) allows for the systems' (100, 200, 300) to identify the borders and extents of each of the printable areas delineated by the alignment indicators (601). In one example, the alignment indicators (601) may be printed to divide printable areas of the web substrate (150). In another example, the alignment indicators (601) may be printed on an edge of the web substrate (150). However, the alignment indicators (601) may be printed anywhere on the web substrate (150) imageable by an optical sensor (103).

The web substrate (150) may be longer than depicted in FIG. 6. However, the patterns of stamp and blank are depicted in FIG. 6 where the "stamped" portions equating to those portions of the web substrate (150) that are printed by the first print engine (101) are depicted as element 602. Those portions of the web substrate (150) that are not printed on by the first print engine (101) are left blank and are designated as element 605 in FIG. 6. The pattern created by the printing performed by the first print engine (101) on the web substrate (150) is indicated by bracket 101.

The buffer (205) collects the web substrate (150) as described herein, and such action is indicated by bracket 205. The pattern created by the printing performed by the second print engine (102) on the web substrate (150) is indicated by bracket 102. As indicated by the shading of the two different printings of the first (101) and second (102) print engines, portions equating to those portions of the web substrate (150) that are printed by the second print engine (102) are designated by 603. In this manner, the second print engine (102) prints in the blank areas (605) left by the first print engine (101).

Printed areas (602, 603) are depicted as being smaller than the total distance between the alignment indicators (601) so as to provide a clear delineation in the figures between print areas of the web substrate (150). However, in one example, the distance between the printed areas (602, 603) as designated by the alignment indicators (601) may be less than is perceptible by a human eye. In other words, the printed areas (602) as viewed by the human eye may imperceptibly touch printed areas (603). This reduces waste of web substrate (150) since more of the web substrate (150) is printed on without cutting leading or trailing edges of the web substrate (150) from the printed areas (602, 603). In one example, the distance between the printed areas (602, 603) may be less than approximately 250 micrometers (μm).

Figure 7:
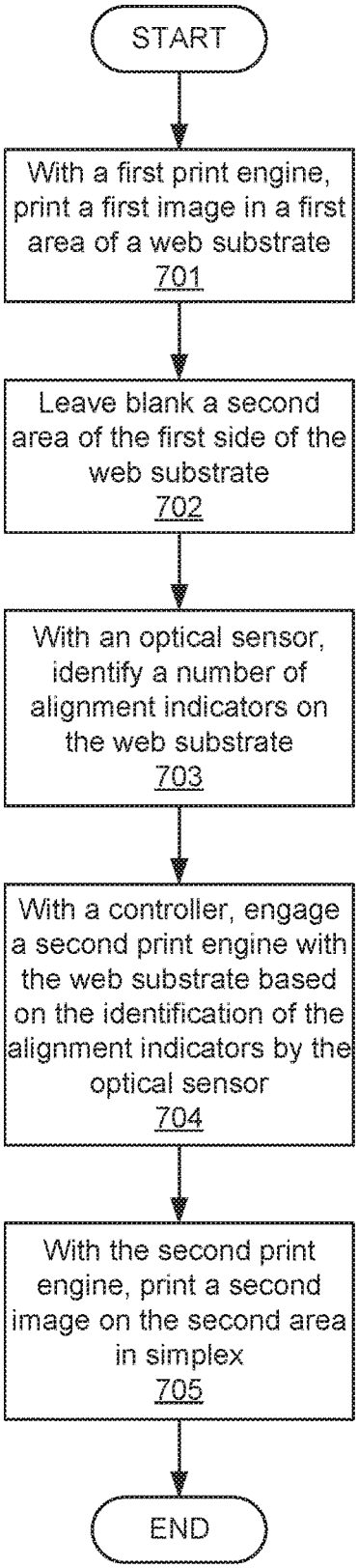
FIG. 7 is a flowchart showing a method of printing on the substrate using the systems described herein, according to an example of the principles described herein.

FIG. 7 is a flowchart showing a method of printing on the web substrate (150) using the systems (100, 200, 300) described herein, according to an example of the principles described herein. The method may begin by printing (block 701), with a first print engine (101), a first image (602) in a first area of a web substrate (150) and leave blank (block 702) a second area (604) of the web substrate (150).

The method may further include, with an optical sensor (103), identifying (block 703) a number of alignment indicators (601) on the web substrate (150). The controller (104) may instruct the second print engine (102) to engage (block 704) with the web substrate (150) based on the identification of the alignment indicators (601) by the optical sensor (103). A second print engine (102) in series with the first print engine (101) may print (block 705) a second image on the second area (604) of the web substrate (150) in simplex. In this manner, the web substrate (150) is printed in simplex using the stamp and blank process described herein.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general-purpose computer, special purpose computer, or other programmable data processing apparatus to produce a machine, such that the computer usable program code, when executed via, for example, the controller (104) of the printing devices and systems described herein or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a printing device including a first print engine to print a first image in a first area of a web substrate and leave blank a second area of the web substrate, a second print engine in series with the first print engine to print a second image on the second area of the web substrate in simplex. The printing device may also include an optical sensor to identify a number of alignment indicators on the web substrate, and a controller to engage the second print engine with the web substrate based on the identification of the alignment indicators by the optical sensor. The printing device and systems provide for a more reliable and faster printing process using a stamp and blank process while providing individual print engines to print a larger number of colors.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printing device, comprising:

a first print engine to print a first image in a first area of a web substrate and leave blank a second area of the web substrate, and to print a number of alignment indicators on the web substrate to delineate a border of the second, blank area, wherein spacing of the number of alignment indicators is variable based on a location of the second, blank area;

a second print engine in series with the first print engine to print a second image on the second area of the web substrate in simplex;

an optical sensor to identify the number of alignment indicators on the web substrate; and a controller to engage the second print engine with the web substrate based on the identification of the alignment indicators by the optical sensor;

wherein the first print engine and the second print engine both print at least four colors and a white printable fluid to the web substrate.

2. The printing device of claim 1, further comprising a buffer disposed between the first and second print engines, wherein the buffer stores a variable amount of web substrate received from the first print engine and feed the web substrate to the second print engine.

3. The printing device of claim 2, wherein the buffer comprises rollers and a linear encoder to determine a distance between the rollers in the buffer for the controller.

4. The printing device of claim 1, wherein each of the first and second print engines prints to the web substrate independent of a speed of the other of the first and second print engines.

5. The printing device of claim 1, further comprising a linear encoder and a buffer, wherein the controller to engage the second print engine with the web substrate based on the identification of the alignment indicators by the optical sensor comprises:

circuitry in the first print engine to receive data from the linear encoder and stall print operations in the first print engine if the data indicates that the buffer is full; and circuitry in the second print engine to receive the data and stall print operations in the second print engine if the data indicates that the buffer comprises less substrate than an amount for continued print operations, wherein the data corresponds to an amount of web substrate stored in the buffer.

6. The printing device of claim 1, wherein each of the first and second print engines selectively performs a null printing cycle, a stalled printing cycle, or combinations thereof, to synchronize print operations between the first and second print engines.

7. The printing device of claim 1, wherein each of the first and second print engines prints to the web substrate independent of a print phase of the other of the first and second print engines.

8. The printing device of claim 1, wherein the alignment indicators are added to the first image printed by the first print engine.

9. The printing device of claim 1, wherein the first print engine is to print a plurality of alignment indicators to divide the web substrate into the first area and the second area.

10. The printing device of claim 9, wherein the controller is to determine borders and extents of the second area based on the optical sensor identifying the plurality of alignment indicators.

11. The printing device of claim 1, wherein the alignment indicators separate the first area from the second area, and wherein a distance between the alignment indicators and the first area from the second area is less than approximately 250 micrometers.

12. A system for printing to a substrate, comprising:

a first print engine to print a first image in a first area of the substrate and leave blank a second area of a first side of the substrate, and to print a number of alignment indicators on the substrate at a border of the first area and the second, blank area, wherein spacing of the number of alignment indicators is variable based on a location of the second, blank area;

a second print engine in series with the first print engine to print a second image on the second area of the first side in simplex;

an optical sensor to identify the number of alignment indicators;

a controller to engage the second print engine with the substrate based on the identification of the alignment indicators by the optical sensor; and an in-line priming station to alter a surface tension of the substrate prior to printing with the first print engine.

13. The system of claim 12, wherein the first print engine and the second print engine both print a white printable fluid to the substrate.

14. The system of claim 12, further comprising:

a buffer;

a sensor within the buffer; and control circuitry coupled to the buffer to activate an actuator to maintain constant tension on the substrate based on data from the sensor within the buffer.

15. The system of claim 12, wherein each of the first and second print engines is selectively performs a null printing cycle, a stalled printing cycle, or combinations thereof, to synchronize print operations between the print engines.

16. The system of claim 12, further comprising a linear encoder and a buffer, wherein the controller comprises:

circuitry in the first print engine to receive data from the linear encoder and stall print operations in the first print engine if the data indicates that the buffer is full; and circuitry in the second print engine to receive the data and stall print operations in the second print engine if the data indicates that the buffer comprises less substrate than an amount for continued print operations, wherein the data corresponds to an amount of substrate stored in the buffer.

17. The system of claim 12, further comprising a linear encoder and a buffer, the controller further to:

receive data from the linear encoder defining an amount of print substrate stored in the buffer, and stall print operations in the first print engine if the data indicates that the buffer is full; and stall print operations in the second print engine if the data indicates that the buffer comprises less print substrate than an amount for continued print operations.

18. The system of claim 12, wherein a distance between the first area and the second area is less than 250 micrometers (μm).

19. The system of claim 12, wherein the first print engine is to print the alignment indicators to the substrate.

20. A system comprising:

a first print engine to print a first image in a first area of a print substrate and leave blank a second area of the print substrate, the first print engine further to print an alignment indicator to the print substrate at a border of the first area and the second, blank area, wherein spacing of the alignment indicator is variable based on a location of the second, blank area;

a second print engine in series with the first print engine to print a second image on the second area of the print substrate in simplex;

an optical sensor to identify the alignment indicator; and a controller to engage the second print engine with the print substrate based on the alignment indicator printed by the first print engine and identified by the optical sensor so as to print the second image in the second area with the second print engine.

* * * * *